United States Patent [19]

Mayer et al.

[11] 3,992,560

[45] Nov. 16, 1976

[54] PROCESS FOR FLAMEPROOFING ORGANIC FIBRE MATERIAL BY THE TRANSFER PROCESS

[75] Inventors: Fritz Mayer, Haltingen, Germany; Jörg Kern, Oberwil; Hermann Nachbur, Dornach, both of Switzerland

[73] Assignee: CIBA-GEIGY AG, Basel, Switzerland

[22] Filed: June 18, 1974

[21] Appl. No.: 480,337

[30] Foreign Application Priority Data

June 22, 1973 Switzerland ..... 9187/73
July 26, 1973 Switzerland ..... 10928/73

[52] U.S. Cl. ..... 428/921; 8/2.5 A; 101/470; 427/248 R

[51] Int. Cl.[2] ..... C23C 11/00; C09K 3/28

[58] Field of Search ..... 117/136; 252/8.1; 8/2.5 A; 106/15 FP; 156/230; 427/390, 394, 248; 101/470; 428/921

[56] References Cited

UNITED STATES PATENTS

| | | | |
|---|---|---|---|
| 3,559,317 | 2/1971 | Knight et al. | 117/3.2 |
| 3,645,936 | 2/1972 | Gardner | 117/136 |
| 3,650,820 | 3/1972 | DiPietro et al. | 117/136 |
| 3,660,582 | 5/1972 | DiPietro et al. | 117/136 |
| 3,666,402 | 5/1972 | Meyers et al. | 117/136 |
| 3,707,346 | 12/1972 | Marbert et al. | 8/2.5 |
| 3,715,310 | 2/1973 | Butcher | 117/136 |
| 3,915,628 | 10/1975 | Bossard et al. | 8/2.5 |

FOREIGN PATENTS OR APPLICATIONS

| | | |
|---|---|---|
| 1,243,219 | 8/1971 | United Kingdom |

*Primary Examiner*—Michael Lusignan
*Attorney, Agent, or Firm*—Joseph G. Kolodny; Edward McC. Roberts; Prabodh I. Almaula

[57] ABSTRACT

A process for flameproofing organic fiber material by the dry thermal transfer process is provided. In this process, a preparation is applied to an inert carrier which is then brought into contact with the fiber materials especially polyamide, polyacrylonitrile or linear polyester fibers, thereafter the carrier and the material to be finished are subjected to a heat treatment at not less than 80° C and the finished material is then separated from the carrier.

The preparation which is applied in this process contains a halogen compound of the formula $$R_0 - X - A_0$$

wherein $R_0$ is halogenoalkyl, X is —CO—NY—, —COO—, —OCO— or —O—, Y is hydrogen or hydroxyalkyl, $A_0$ is halogenoalkyl, —$NH_2$, alkylene—COOH or —alkylene—O-halogenoalkyl, and wherein, if X is —CO—NY— and Y is hydrogen, $A_0$ can also be hydrogen, and if X is —O—, $R_0$ and $A_0$ can also be halogenoalkyl or halogenoalkenyl.

12 Claims, No Drawings

PROCESS FOR FLAMEPROOFING ORGANIC FIBRE MATERIAL BY THE TRANSFER PROCESS

The subject of the invention is a process for flameproofing organic fibre material by the dry thermal transfer process, characterised in that a preparation which contains at least a. a halogen compound of the formula $$R_0 - X - A_0 \quad (1)$$

wherein $R_0$ denotes halogenoalkyl with 1 to 4 carbon atoms, X denotes —CO—NY—, —COO—, —OCO— or —O—, Y denotes hydrogen or hydroxyalkyl with 1 to 4 carbon atoms, $A_0$ denotes halogenoalkyl with 1 to 4 carbon atoms, $—NH_2$, alkenylene-COOH with 3 or 4 carbon atoms or -alkylene-O-halogenoalkyl with 1 to 4 carbon atoms in the alkylene radical and 1 to 4 carbon atoms in the halogenoalkyl radical, and wherein, if X denotes —CO—NY— and Y denotes hydrogen, $A_0$ can also be hydrogen, and if X denotes —O—, $R_0$ and $A_0$ can also be halogenoalkyl or halogenoalkenyl with 3 to 6 carbon atoms, b. optionally a binder which is stable below 250° C and c. optionally a solvent is applied to an inert carrier and is optionally dried, the carrier is then brought into contact with the surface of the fibre material which is to be flameproofed, and thereafter the carrier and the material to be finished are subjected to a heat treatment at not less than 80° C, if appropriate with use of mechanical pressure, until the halogen compound has been transferred to the fibre material, and the finished material is then separated from the carrier.

Halogen compounds of particular interest for the process are those of the formula $$R_1 - X_1 - A_{0_1} \quad (2)$$

wherein $R_1$ denotes halogenoalkyl with 2 or 3 carbon atoms and 1 to 3 halogen atoms, $X_1$ denotes $—CO—NY_1—$, —OCO— or —O—, $Y_1$ denotes hydrogen or methylol and $A_{0_1}$ denotes n-2,3-dibromopropyl, $—NH_2$, —CH=CH—COOH or alkylene-O-halogenoalkyl with 2 or 3 carbon atoms in the alkylene radical and 2 or 3 carbon atoms in the halogenoalkyl radical, which also contains 1 to 3 halogen atoms, and wherein, if $X_1$ denotes $—CO—NY_1—$ and $Y_1$ denotes hydrogen, $A_{0_1}$ can also be hydrogen.

The halogen compound according to (a) is preferably a compound which corresponds to the formula $$R - X - A \quad (3)$$

wherein R denotes halogenoalkyl with 1 to 4 carbon atoms, X denotes —CO—NY—, —COO—, —OCO— or —O—, Y denotes hydrogen or hydroxyalkyl with 1 to 4 carbon atoms and A denotes halogenoalkyl with 1 to 4 carbon atoms, $—NH_2$, alkenylene-COOH with 3 or 4 carbon atoms or -alkylene-O-halogenoalkyl with 1 to 4 carbon atoms in the alkylene radical and 1 to 4 carbon atoms in the halogenoalkyl radical, and especially those which correspond to the formula $$R_1 - X_1 - A_1 \quad (4)$$

wherein $R_1$ denotes halogenoalkyl with 2 or 3 carbon atoms and 1 to 3 halogen atoms, $X_1$ denotes $—CO—NY_1—$, —OCO— or —O—, $Y_1$ denotes hydrogen or methylol and $A_1$ denotes n-2,3-dibromopropyl, $—NH_2$, —CH=CH—COOH or alkylene-O-halogenoalkyl with 2 or 3 carbon atoms in the alkylene radical and 2 or 3 carbon atoms in the halogenoalkyl radical, which also contains 1 to 3 halogen atoms.

Further advantageous halogen compounds are the compounds of the formula (1) or (2) wherein, if X or $X_1$ denotes —CO—NY— or $—CO—NY_1—$ and Y or $Y_1$ denotes hydrogen, $A_0$ or $A_0$ can also be hydrogen, and those of the formula (1) wherein, if X denotes —O—, $R_0$ and $A_0$ can also be halogenoalkyl or halogenoalkenyl with 3 to 6 carbon atoms.

A particularly suitable compound is that of the formula (5.1) $CH_2(Br)—CH(Br)—CH_2—O—CH_2—O—CH_2—CH(Br)—CH_2(Br)$ Examples of further compounds which can be employed are those of the following formulae:

(5.2) $CH_2(Br)—CH(Br)—CO—N(CH_2OH)_2$ (5.3) $CH_2(Cl)—CH_2—COO—CH_2—CH(Br)—CH_2(Br)$ (5.4) $CH_2(Br)—CH(Br)—CH_2—O—CO—NH_2$ (5.5) $CH_2(Br)—CH(Br)—CH_2—O—CO—CH=CH—COOH$ (5.6) $CH_2(Br)—CH(Br)—CO—NH—CH_2OH$ (5.7) $CH_2(Cl)—COO—CH_2—CH(Br)—CH_2(Br)$ (5.8) $CH_2(Br)—CH(Br)—CO—NH_2$

Amongst these, the compounds of the formulae (5.3), (5.7) and (5.8) are preferred.

The compounds of the formula (1) are in themselves known or are manufactured according to known methods.

Possible halogenoalkyl radicals in the definition of $R_0$ or $A_0$ are above all radicals with 2 or 3 carbon atoms and 1 to 3 halogen atoms, such as chlorine or especially bromine. Examples of possible halogenoalkyl radicals are chloromethyl, bromomethyl, 2-bromoethyl, 2-chloroethyl, 1,2-dibromoethyl, 2,3-dibromo-n-propyl, 3-bromo-n-propyl, 2,2,3-tribromo-n-propyl, 2-chloro-2,3-dibromo n-propyl and the like, with chloromethyl but above all 2-chloroethyl, 1,2-dibromoethyl and especially 2,3-dibromo-n-propyl being preferred. Hydroxyalkyl in the definition of Y and $A_0$ is, for example, 2-hydroxyethyl or especially methylol. $A_0$ is further derived from radicals of unsaturated dicarboxylic acids such as fumaric acid or maleic acid. -Alkylene-O-halogenoalkyl is preferably -methylene-O-halogeno-n-propyl, wherein halogen represents, inter alia, chlorine or especially bromine. Furthermore, if X denotes —O—, $R_0$ and $A_0$ can each represent halogenoalkenyl, preferably halogenoalkenyl with 6, and preferably 5, carbon atoms and 2 halogen atoms, especially 2 bromine atoms.

The preparations which can be used in accordance with the process can also contain, in addition to the flameproofing agent of the formula (1) which is transferred to the fibre material, at least one binder which is stable below 250° C, water and/or an organic solvent.

Suitable binders are synthetic, semi-synthetic and natural resins, and in particular both polycondensation and polyaddition products. In principle, all binders customary in the lacquer and printing ink industry can be used. The binders serve to retain the bromine compounds of the formula (1) on the treated part of the carrier. At the transfer temperature they should, however, not melt, not react with themselves, for example crosslink, and be capable of releasing the compound to be transfered. Preferred binders are those which, for example, dry rapidly in a warm stream of air and form a fine, preferably non-tacky, film on the carrier. As examples of suitable water-soluble binders there may be mentioned: alginate, tragacanth, carubin (from carob bean flour), dextrin, etherified or esterified vegetable mucins, carboxymethylcellulose or polyacrylamide, whilst as binders soluble in organic solvents there may be mentioned cellulose esters, such as nitrocellulose or cellulose acetate and especially cellulose ethers, such as methylcellulose, ethylcellulose, propylcellulose, isopropylcellulose, benzylcellulose or hydroxyethylcellulose as well as their mixtures. Particularly good results are achieved with ethylcellulose.

As organic solvents it is possible to use water-miscible or water-immiscible organic solvents or solvent mixtures of boiling point below 150° C, preferably below 120° C, under normal pressure. Advantageously, aliphatic, cycloaliphatic or aromatic hydrocarbons, such as toluene, cyclohexane, or petroleum ether, lower alkanols, such as methanol, ethanol, propanol, isopropanol, esters of aliphatic monocarboxylic acids, such as ethyl acetate or propyl acetate, aliphatic ketones, such as methyl ethyl ketone and halogenated aliphatic hydrocarbons, such as perchloroethylene, trichloroethylene, 1,1,1-trichloroethane or 1,1,2-trichloro-2,2,1-trifluoroethylene are used. Particularly preferred solvents are lower aliphatic esters, ketones or alcohols, such as butyl acetate, acetone, methyl ethyl ketone, isopropanol, butanol or above all ethanol, as well as their mixtures, for example a mixture of methyl ethyl ketone and ethanol in the ratio of 1:1. The desired viscosity of the printing pastes can then be obtained by adding the stated binders together with a suitable solvent.

The weight ratio of the individual components in the preparation can vary greatly and is, for example, from 20 to 100 per cent by weight in the case of the compounds of the formula (1), from 0 to 30 per cent by weight in the case of the binder, and from 0 to 70 per cent by weight in the case of water or the organic solvent or solvent mixture, relative to the total weight of the preparation. The amounts of compound, to be transferred to the fibre material, applied to the temporary carrier can be, for example, 10 to 100 g, preferably 20 to 50 g, per $m^2$ of carrier.

The preparations used according to the invention are prepared by dissolving or finely dispersing the bromine compound of the formula (1) in water and/or organic solvent, advantageously in the presence of a binder which is stable below 250° C.

Further, it is also possible to apply compounds of the formula (1) directly as such onto the carrier, that is to say without solvents or binder, for example by sprinkling, doctoring, pouring, spraying or padding.

The process according to the invention is suitably carried out by applying the preparation to an inert temporary carrier, bringing the treated side of the carrier into contact with the fibre material which is to be treated, subjecting the carrier and the fibre material to the action of heat at not less than 80° C, preferably not less than 130° C, and separating the fibre material from the carrier.

The temporary carrier required in accordance with the process can be endless or be matched to the textile shapes which are to be treated, that is to say cut into shorter or longer pieces. As a rule it has no affinity for the preparation used. Suitably, the carrier is a flexible, preferably dimensionally stable, band, a strip or a film, preferably having a smooth surface, which is stable to heat and can consist of materials of the most diverse kind, for example metal, such as an aluminum foil or steel foil, plastic, paper or textile sheet-like structures, such as woven fabrics, knitted fabrics or fleeces which can be optionally coated with a film of vinyl resin, ethylcellulose, polyurethane resin or polytetrafluoroethylene. Suitable, polyester on polyamide knitted fabrics, a needle-punched felt of polytetrafluoroethylene fibres, flexible aluminium foils, sheets of glass fibre fabric or above all sheets of paper are used.

After the preparations have been applied to the carrier, they are dried, for example be means of a warm stream of air or by infra-red irradiation, the solvent used optionally being recovered.

The treated side of the carrier is thereupon brought into close contact with the surface of the fibre material to be treated, and the combination is subjected to a heat treatment at not less than 80° C and preferably 150° to 220° C, particularly 150° to 200° C.

These temperatures are maintained for a sufficient period of time, preferably 5 to 120 seconds, until the compound of the formula (1) has been transferred to the fibre material to be treated.

Changes in temperature and in time can result in corresponding changes in the amount of coating for the same chemicals presented. It is therefore possible to regulate the transfer of the chemicals to the fibre material, and hence the amount of coating, through regulating the temperature and the transfer time.

The exposure to heat can be effected in various known ways, for example by means of a heating plate or by passing through a tunnel-shaped heating zone or over a hot heating drum, advantageously in the presence of an unheated or heated counterroller which exerts pressure, or through a hot calender, or by means of a heated plate (iron or warm press), optionally in vacuo, the heating devices being preheated to the requisite temperature by steam, oil or infra-red radiation or being located in a preheated chamber. After completion of the heat treatment, the textile goods are separated from the carrier.

Preferably, in addition to natural finishes such as cellulose, mainly synthetic fibre material are to be mentioned, such as, for example, cellulose ester fibres, cellulose 2½-acetate and triacetate fibres, synthetic polyamide fibres, for example those from polycaprolactam (nylon 6), from polyaminoundecanoic acid (nylon 7) or especially from polyhexamethylenediamine adipate (nylon 6,6), polyurethane or polyolefine fibres, for example polypropylene fibres, acidmodified polyamides, such as polycondensation products of 4,4'-diamino-2,2'-diphenyldisulphonic acid or 4,4'-diamino-2,2'-diphenylalkanedisulphonic acids with polyamide-forming starting materials, polycondensation products of monoaminocarboxylic acids or their amide-forming derivatives or of dibasic carboxylic acids and diamines with aromatic dicarboxysulphonic acids, for example polycondensation products of 2-caprolactam or hexamethylenediammonium adipate with potassium 3,5-dicarboxybenzenesulphonate, or acid-modified polyester fibres, such as polycondensation products of aromatic polycarboxylic acids, for example terephthalic acid or isophthalic acid, polyhydric alcohols, for example ethylene glycol and 1,2- or 1,3-dihydroxy-3-(3-sodium sulphopropoxy)-propane, 2,3-dimethylol-1-(3-sodium-sulphopropoxy)-butane, 2,2-bis-(3-sodium-sulphopropoxyphenyl)-propane or 3,5-dicarboxybenzenesulphonic acid or sulphonated terephthalic acid, sulphonated 4-methoxybenzenecarboxylic acid or sulphonated diphenyl-4,4'-dicarboxylic acid.

Preferably, however, fibre material of polyacrylonitrile or acrylonitrile copolymers and above all linear polyester fibres, especially of polyethylene glycol terephthalate or poly-(1,4-cyclohexanedimethylol) terephthalate, are used. If acrylonitrile copolymers are used, the proportion of acrylonitrile is suitably at least 50% and preferably at least 85 per cent by weight of the copolymer. The comonomers used are normally other vinyl compounds, for example vinylidene chloride, vinylidene cyanide, vinyl chloride, methacrylate, methylvinylpyridine, N-vinylpyrrolidone, vinyl acetate, vinyl alcohol, acrylamide or styrenesulphonic acids.

These fibre materials can also be used as mixed fabrics, the fibre materials being mixed with one another or with other fibres, examples being mixtures of polyacrylonitrile/polyester, polyamide/polyester, polyester/viscose and polyester/wool.

The fibre material can be in the most diverse states of processing, for example in the form of flocks, tow, yarn, texturised filaments, woven fabrics, knitted fabrics, fibre fleeces or textile floor coverings, such as needle-punched felt carpets, pile carpets or bundles of yarns.

The preparations which can be used according to the invention are applied to the temporary carrier by, for example, whole-area or partial spraying, coating or printing.

The temporary carriers can also be treated on both sides or, if appropriate, on the back, and unequal concentrations of the coatings can be selected for the two sides.

In the examples which follow the percentages are percentages by weight.

EXAMPLE 1

The compound of the formula (5.1) is coated by means of a doctor blade, or sprayed, onto a glass fibre fabric (coating 30 g/m²). The glass fibre fabric is brought together with a polyamide knitted fabric, with the coated side facing away from the latter. The carrier and the fabric are then subjected to a heat treatment at 195° C between two heating plates for 30 seconds. The glass fibre fabric is then separated from the polyamide fabric without problems due to adhesion of the layer of chemicals to the finished polyamide fabric.

The polyamide fabric is flameproof according to DIN 53,906, in contrast to the untreated fabric.

EXAMPLE 2

25% of the compound of the formula (5.1) — relative to the weight of the goods — dissolved in ethanol are padded onto a polyester knitted fabric (240 g/m²). The "textile carrier" prepared in this way is then brought together with an equal amount of untreated identical polyester knitted fabric and the combination is packaged in an aluminium foil. The packaged knitted fabrics are together subjected to a heat treatment at 195° C for 25 seconds. The two knitted fabrics are then separated from one another.

About one-third of the compound of the formula (5.1) has been transferred from the carrier knitted fabric to the receiver knitted fabric.

After 40 use-type washes, 5% of the compound of the formula (5.1) still remain on the receiver knitted fabric, which is flameproof according to DIN 53,906, in contrast to untreated knitted fabrics.

EXAMPLE 3

The compound of the formula (5.1) is dissolved in a 1:1 ethanol/methyl ethyl ketone mixture (to give a 70% strength solution). A polyamide knitted fabric (180 g/m²) is charged with 20% of the active substances on a padder.

The "textile carrier" thus prepared is then brought together with an equal amount of untreated identical polyamide knitted fabric and the combination is packaged in an aluminium foil and subjected to a heat treatment for 25 seconds at 195° C. The two fabrics are then separated from one another.

About one-third of the compound of the formula (5.1) has been transferred from the carrier fabric to the receiver fabric.

In contrast to the untreated fabric, the fabrics finished in this way are still flameproof, according to DIN 53,906, even after 5 use-type washes.

EXAMPLE 4

750 g of the product of the formula (5.1) or (5.4) are worked into a paste in 100 g of ethylcellulose and 350 g of a 1:1 mixture of ethanol and methyl ethyl ketone and 24 or 48 g/m² are applied to paper.

The coated side of the carrier is brought into contact with a polyester knitted fabric (240 g/m²) and the combination is subjected to a heat treatment at 195° C between two heating plates for 25 seconds. The carrier and the knitted fabric are then separated from one another.

The knitted fabrics are then tested for their flame resistance according to DOC FF 3-71 ("Children's Sleepwear Test"), the test being carried out after finishing and after 1, 5, 10, 20 and 40 use-type washes at 40° C in a liquor containing 4 g/l of a commercial detergent for delicate fabrics.

The result is summarised in the table which follows.

| | Coating, g/m² | Tested | | | | | | | | | | | |
|---|---|---|---|---|---|---|---|---|---|---|---|---|---|
| | | After finishing | | After 1 wash | | After 5 washes | | After 10 washes | | After 20 washes | | After 40 washes | |
| | | TL | BT | TL | BT | TL | BT | TL | BT | TL | BT | TL | BT |
| Untreated | | 12 | 22 | 4 | 9 | 10 | 25 | 4 | 19 | Burns | 28 | 6 | 15 |
| Treated with compound of the formula | | | | | | | | | | | | | |
| (5.1) | 24 | 5 | 1 | 4 | 1 | 6 | 2 | 5 | 7 | 5 | 1 | 5 | 1 |
| (5.1) | 48 | 5 | 2 | 4 | 1 | 4 | 3 | 6 | 5 | 5 | 1 | 5.5 | 6 |
| (5.4) | 24 | 8.5 | 2 | 4 | 1 | 4.5 | 4 | 5 | 2 | 6 | 1 | 6 | 4 |
| (5.4) | 48 | 5 | 1 | 4 | 1 | 4 | 1 | 4 | 2 | 5 | 1 | 4 | 1 |

TL : Tear length in cm
BT : Burning time in seconds.

Instead of the compound of the formula (5.1) or (5.4), a compound of the formula (5.2), (5.3), (5.5), (5.6) or (5.7) can be used with similar success.

DOC FF 3-71 ("Children's Sleepwear Test") comprises the following flameproofing test:

"5 Pieces of fabric (8.9 cm × 25.4 cm) are clamped in a test frame and dried for 30 minutes at 105° C in a circulating air drying cabinet. The pieces of fabric are subsequently conditioned in a closed vessel over silica gel for 30 minutes and then subjected to the actual flame-resistance test in a burning box. The fabrics are in each case ignited for 3 seconds with a methane gas flame, the fabrics being in the vertical position.

The test is considered to have been withstood if the average charred zone is not longer than 17.5 cm and no one sample has a charred zone of more than 25.4 cm, and the individual smouldering times are not longer than 10 seconds."

EXAMPLE 5

22.5 or 45 g of a compound of the formula (5.1) are converted to a paste with 3 g or 6 g of ethylcellulose and 10.5 or 21 g of a 1:1 ethanol/methyl ethyl ketone mixture and the paste is applied to a paper carrier of 1 m² surface area.

This carrier is then brought together with a polyacrylonitrile fibre carpet (pile weight 1,000 g/m², pile height 6 mm), with the coated side against the carpet, and the combination is warmed to 190° C between two heating plates for 40 seconds without using pressure. The carrier and carpet are then separated from one another.

The carpet samples are then tested according to DIN 51,960, that is to say after finishing and after one and 3 shampooings. In contrast to an untreated sample, the treated samples are difficult to ignite. The results are summarised in the table which follows.

Shampooing

A commercial shampoo is mixed with water in the ratio of 8:1 and worked into a lather by means of a sponge. The foam is then applied to the carpet and well massaged into the pile by means of the sponge. After drying at room temperature, shampoo residues are thoroughly removed by means of a vacuum cleaner.

| | Coating g/m² | Tested | | | | | |
|---|---|---|---|---|---|---|---|
| | | After finishing | | After 1 shampooing | | After 3 shampooings | |
| | | BL | BT | BL | BT | BL | BT |
| Untreated | | Burns away | 7' | Burns away | 6'45" | Burns away | 12'15" |
| Treated with compound of the formula | | | | | | | |
| (5.1) | 22.5 | 5.5 | 5:05 | 7 | 5:25 | 7 | 4:05 |
| (5.1) | 45 | 8 | 5:50 | 6 | 4:50 | 6 | 3:40 |

BL : Burning length in cm
BT : Burning time in minutes + seconds

EXAMPLE 6

750 g of the compound of the formula (5.7) are converted to a paste in 100 g of ethylcellulose and 350 g of a 1:1 mixture of ethanol and methyl ethyl ketone and the paste is uniformly applied to an aluminium foil so as to produce a coating of 36 g/m² of the compound of the formula (5.7).

The coated side of the aluminium foil is brought into contact with a knitted fabric of polyamide-6,6 fibres and the combination is subjected to the action of heat at 195° C between two heating plates for 30 seconds. Thereafter the aluminium foil and the polyamide knitted fabric are separated from one another.

On testing the flame resistance of the polyamide knitted fabric treated in this way in comparison with untreated knitted fabric, according to DOC FF 3-71, the following results are obtained:

| | Burning time in seconds | Tear length in cm |
|---|---|---|
| Treated knitted fabric | 4 | 5.5 |
| Untreated knitted fabric | 30 | Burns away completely |

EXAMPLE 7

A paste of 1 part of the compound of the formula (5.8) and 1 part of water is uniformly padded by means of a smooth steel roller onto a needle-punched fleece of polytetrafluoroethylene fibres to produce a coating of 90 g/m² of the compound of the formula (5.8).

The coated side of the needle-punched fleece of polytetrafluoroethylene fibres is brought into contact with the pile side of a tufted carpet of polyacrylonitrile fibres (600 g/m²) and the combination is subjected to the action of heat at 160° C, applied from the uncoated side of the needle-punched fleece of polytetrafluoroethylene fibres, on a heating plate for 1 minute. The needle-punched fleece is then separated from the carpet.

On testing the flame resistance of the polyacrylonitrile carpet treated in this way in comparison to an untreated carpet, in accordance with DIN 51,960, the following results are obtained.

| | Burning time in seconds | Burning length in cm |
|---|---|---|
| Treated carpet | 0 | 4.5 |
| Untreated carpet | 8 | Burns away completely |

We claim:

1. Process for flameproofing organic fiber material by the dry thermal process which comprises applying to an inert carrier a preparation containing a halogen compound of the formula $$R_0 - X - A_0$$

wherein $R_0$ is halogenoalkyl with 1 to 4 carbon atoms, X is —CO—NY—, —COO—, —OCO— or —O—, Y is hydrogen or hydroxyalkyl with 1 to 4 carbon atoms, $A_0$ is halogenoalkyl or hydroxyalkyl with 1 to 4 carbon atoms, —$NH_2$, alkylene-COOH with 3 or 4 carbon atoms or -alkylene-O-halogenoalkyl with 1 to 4 carbon atoms in the alkylene radical and 1 to 4 carbon atoms in the halogenoalkyl radical, and wherein, if X is —CO—NY— and Y is hydrogen, $A_0$ can also be hydrogen, and if X is —O—, $R_0$ and $A_0$ can also be halogenoalkyl or halogenoalkenyl with 3 to 6 carbon atoms, then bringing the carrier into contact with the surface of the fiber material which is to be flameproofed, thereafter subjecting the carrier and the material to be finished to a heat treatment at 150° to 220° C until the halogen compound has been transferred to the fiber material, and then separating the finished material from the carrier.

2. Process according to claim 1 which comprises applying a preparation containing a halogen compound of the formula $$R_1 - X_1 - A_0$$

wherein $R_1$ is halogenoalkyl with 2 or 3 carbon atoms and 1 to 3 halogen atoms, $X_1$ is —CO—$NY_1$—, —OCO— or —O—, $Y_1$ is hydrogen or methylol and $A_0$ is n-2,3-dibromopropyl, methylol, —$NH_2$, —CH=λ CH—COOH or alkylene-O-halogenoalkyl with 2 or 3 carbon atoms in the alkylene radical and 2 or 3 carbon atoms in the halogenoalkyl radical, which also contains 1 to 3 halogen atoms, and wherein if $X_1$ is —CO—$NY_1$— and $Y_1$ is hydrogen, $A_0$ can also be hydrogen.

3. Process according to claim 1 which comprises applying a preparation containing a halogen compound of the formula $$R - X - A$$

wherein R is halogenoalkyl with 1 to 4 carbon atoms, X is —CO—NY—, —COO—, —OCO— or —O—, Y is hydrogen or hydroxyalkyl with 1 to 4 carbon atoms and A is halogenoalkyl or hydroxyalkyl with 1 to 4 carbon atoms, —$NH_2$, alkylene—COOH with 3 or 4 carbon atoms or -alkylene-O-halogenoalkyl with 1 to 4 carbon atoms in the alkylene radical and 1 to 4 carbon atoms in the halogenoalkyl radical.

4. Process according to claim 3, which comprises applying a preparation containing a halogen compound of the formula $$R_1 - X_1 - A_1$$

wherein $R_1$ is halogenoalkyl with 2 or 3 carbon atoms and 1 to 3 halogen atoms, $X_1$ is —CO—$NY_1$—, —OCO— or —O—, $Y_1$ is hydrogen or methylol and $A_1$ is n-2,3-dibromopropyl, methylol, —$NH_2$, —CH=λ CH—COOH or alkylene-O-halogenoalkyl with 2 or 3 carbon atoms in the alkylene radical and 2 or 3 carbon atoms in the halogenoalkyl radical, which also contains 1 to 3 halogen atoms.

5. Process according to claim 3, which comprises applying a preparation containing a halogen compound of the formula

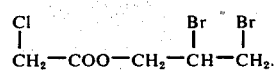

6. Process according to claim 4 which comprises applying a preparation containing a halogen compound of the formula

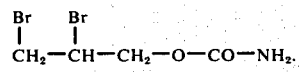

7. Process according to claim 2 which comprises applying a preparation containing a halogen compound of the formula

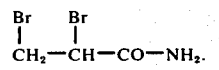

8. Process according to claim 4 which comprises applying a preparation containing a halogen compound of the formula

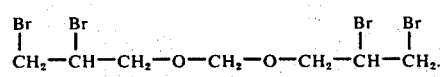

9. Process according to claim 1 which comprises applying a preparation containing, in addition to the halogen compound, a binder which is stable below 250° C and an organic solvent.

10. Process according to claim 1 which comprises applying a preparation containing from 20 to 100 percent by weight of the halogen compound, 0 to 30 percent by weight of a binder which is stable below 250° C and 0 to 70 percent by weight of an organic solvent.

11. Process according to claim 1 which comprises flameproofing polyamide fibers, polyacrylonitrile fibers or linear polyester fibers.

12. The organic fiber material bearing thereon a flameproof finish applied according to the process of claim 1.

* * * * *

UNITED STATES PATENT AND TRADEMARK OFFICE

CERTIFICATE OF CORRECTION

PATENT NO. : 3,992,560

DATED : November 16, 1976

INVENTOR(S) : FRITZ MAYER ET AL.

It is certified that error appears in the above-identified patent and that said Letters Patent are hereby corrected as shown below:

Column 9, claim 2, line 51 delete the formula as it now reads and insert --- $R_1 — X_1 — A_{o_1}$ ---;

line 57 delete "$A_o$" and insert --- $A_{o_1}$ ---;

same line, delete "—CH=λ" and insert ---—CH= ---;

line 62, delete "$A_o$" and insert --- $A_{o_1}$ ---.

Column 10, claim 4, line 17, delete "—CH=λ" and insert ---—CH= ---.

Signed and Sealed this

Eighth Day of March 1977

[SEAL]

*Attest:*

RUTH C. MASON
*Attesting Officer*

C. MARSHALL DANN
*Commissioner of Patents and Trademarks*